US009341128B2

(12) United States Patent
Hayman et al.

(10) Patent No.: US 9,341,128 B2
(45) Date of Patent: May 17, 2016

(54) FUEL CONSUMPTION BASED CYLINDER ACTIVATION AND DEACTIVATION CONTROL SYSTEMS AND METHODS

(71) Applicant: GM Global Technology Operations LLC, Detroit, MI (US)

(72) Inventors: Alan W. Hayman, Romeo, MI (US); Robert S. McAlpine, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 58 days.

(21) Appl. No.: 14/449,726

(22) Filed: Aug. 1, 2014

(65) Prior Publication Data

US 2015/0361907 A1 Dec. 17, 2015

Related U.S. Application Data

(60) Provisional application No. 62/011,286, filed on Jun. 12, 2014.

(51) Int. Cl.
*F02D 41/00* (2006.01)
*F02D 41/10* (2006.01)
(Continued)

(52) U.S. Cl.
CPC ..... *F02D 41/0087* (2013.01); *F02D 41/0097* (2013.01); *F02D 41/10* (2013.01);
(Continued)

(58) Field of Classification Search
CPC . F02D 41/0087; F02D 41/1498; F02D 41/10; F02D 41/0097; F02D 2200/0625; F02D 17/00; F02D 17/02; F02D 13/06; F01L 13/0005; F01L 2013/001
USPC ..... 123/198 F; 701/101, 102, 112
See application file for complete search history.

(56) References Cited

U.S. PATENT DOCUMENTS 3,596,640 A 8/1971 Bloomfield
4,129,034 A 12/1978 Niles et al.
(Continued)

FOREIGN PATENT DOCUMENTS

CN 1888407 A 1/2007
CN 101220780 A 7/2008
(Continued)

OTHER PUBLICATIONS

U.S. Appl. No. 14/734,619, filed Jun. 9, 2015, Matthews.
(Continued)

*Primary Examiner* — Stephen K Cronin
*Assistant Examiner* — Grant Moubry

(57) ABSTRACT

A cylinder control method includes: generating a torque request for an engine based on at least one driver input; based on the torque request, determining a target number of activated cylinders of the engine; determining possible sequences for activating and deactivating cylinders of the engine to achieve the target number of activated cylinders; determining predicted fuel consumption values for the possible sequences, respectively; identifying first ones of the possible sequences having predicted fuel consumption values that are less than a predetermined amount from a lowest one of the predicted fuel consumption values; selecting one of the first ones of the possible sequences; setting a selected sequence for activating and deactivating cylinders of the engine to the selected one of the first ones of the possible sequences; based on the selected sequence, one of activating and deactivating a next cylinder in a predetermined firing order of the cylinders.

20 Claims, 5 Drawing Sheets

(51) Int. Cl.
*F02D 41/14* (2006.01)
*F02D 41/02* (2006.01)

(52) U.S. Cl.
CPC ..... *F02D41/1406* (2013.01); *F02D 41/1498* (2013.01); *F02D 41/021* (2013.01); *F02D 2041/1412* (2013.01); *F02D 2041/1433* (2013.01); *F02D 2200/0625* (2013.01)

(56) References Cited

U.S. PATENT DOCUMENTS 4,172,434 A 10/1979 Coles
4,377,997 A 3/1983 Staerzl
4,434,767 A 3/1984 Kohama et al.
4,489,695 A 12/1984 Kohama et al.
4,509,488 A 4/1985 Forster et al.
4,535,744 A 8/1985 Matsumura
4,770,148 A 9/1988 Hibino et al.
4,887,216 A 12/1989 Ohnari et al.
4,974,563 A 12/1990 Ikeda et al.
4,987,888 A 1/1991 Funabashi et al.
5,042,444 A 8/1991 Hayes et al.
5,094,213 A 3/1992 Dudek et al.
5,226,513 A 7/1993 Shibayama
5,278,760 A 1/1994 Ribbens et al.
5,357,932 A 10/1994 Clinton et al.
5,374,224 A 12/1994 Huffmaster et al.
5,377,631 A 1/1995 Schechter
5,423,208 A 6/1995 Dudek et al.
5,465,617 A 11/1995 Dudek et al.
5,540,633 A 7/1996 Yamanaka et al.
5,553,575 A 9/1996 Beck et al.
5,584,266 A 12/1996 Motose et al.
5,669,354 A 9/1997 Morris
5,692,471 A 12/1997 Zhang
5,720,257 A 2/1998 Motose et al.
5,813,383 A 9/1998 Cummings
5,884,605 A 3/1999 Nagaishi et al.
5,909,720 A 6/1999 Yamaoka et al.
5,931,140 A 8/1999 Maloney
5,934,263 A 8/1999 Russ et al.
5,975,052 A 11/1999 Moyer
5,983,867 A 11/1999 Stuber et al.
6,125,812 A 10/2000 Garabedian
6,158,411 A 12/2000 Morikawa
6,244,242 B1 6/2001 Grizzle et al.
6,247,449 B1 6/2001 Persson
6,272,427 B1 8/2001 Wild et al.
6,286,366 B1 9/2001 Chen et al.
6,295,500 B1 9/2001 Cullen et al.
6,332,446 B1 12/2001 Matsumoto et al.
6,334,425 B1 1/2002 Nagatani et al.
6,355,986 B1 3/2002 Kato et al.
6,360,724 B1 3/2002 Suhre et al.
6,363,316 B1 3/2002 Soliman et al.
6,371,075 B2 4/2002 Koch
6,385,521 B1 5/2002 Ito
6,520,140 B2 * 2/2003 Dreymuller ..... F02D 17/04 123/198 F
6,546,912 B2 4/2003 Tuken
6,619,258 B2 9/2003 McKay et al.
6,622,548 B1 9/2003 Hernandez
6,694,806 B2 2/2004 Kumagai et al.
6,760,656 B2 7/2004 Matthews et al.
6,978,204 B2 12/2005 Surnilla et al.
6,983,737 B2 1/2006 Gross et al.
7,024,301 B1 4/2006 Kar et al.
7,028,661 B1 4/2006 Bonne et al.
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,121 B2 6/2006 Michelini et al.
7,069,718 B2 7/2006 Surnilla et al.
7,069,773 B2 7/2006 Stempnik et al.
7,086,386 B2 8/2006 Doering
7,100,720 B2 9/2006 Ishikawa
7,111,612 B2 9/2006 Michelini et al.
7,140,355 B2 11/2006 Michelini et al.
7,174,879 B1 2/2007 Chol et al.
7,200,486 B2 4/2007 Tanaka et al.
7,203,588 B2 4/2007 Kaneko et al.
7,231,907 B2 6/2007 Bolander et al.
7,278,391 B1 10/2007 Wong et al.
7,292,231 B2 11/2007 Kodama et al.
7,292,931 B2 11/2007 Davis et al.
7,319,929 B1 1/2008 Davis et al.
7,363,111 B2 4/2008 Vian et al.
7,440,838 B2 10/2008 Livshiz et al.
7,464,676 B2 12/2008 Wiggins et al.
7,472,014 B1 12/2008 Albertson et al.
7,497,074 B2 3/2009 Surnilla et al.
7,499,791 B2 3/2009 You et al.
7,503,312 B2 3/2009 Surnilla et al.
7,509,201 B2 3/2009 Bolander et al.
7,577,511 B1 8/2009 Tripathi et al.
7,581,531 B2 9/2009 Schulz
7,614,384 B2 11/2009 Livshiz et al.
7,621,262 B2 11/2009 Zubeck
7,685,976 B2 3/2010 Marriott
7,785,230 B2 8/2010 Gibson et al.
7,836,866 B2 11/2010 Luken et al.
7,849,835 B2 12/2010 Tripathi et al.
7,886,715 B2 2/2011 Tripathi et al.
7,930,087 B2 4/2011 Gibson et al.
7,946,263 B2 5/2011 O'Neill et al.
7,954,474 B2 6/2011 Tripathi et al.
8,050,841 B2 11/2011 Costin et al.
8,099,224 B2 1/2012 Tripathi et al.
8,108,132 B2 1/2012 Reinke
8,131,445 B2 3/2012 Tripathi et al.
8,131,447 B2 3/2012 Tripathi et al.
8,135,410 B2 3/2012 Forte
8,145,410 B2 3/2012 Berger et al.
8,146,565 B2 4/2012 Leone et al.
8,272,367 B2 9/2012 Shikama et al.
8,473,179 B2 6/2013 Whitney et al.
8,616,181 B2 12/2013 Sahandiesfanjani et al.
8,646,430 B2 2/2014 Kinoshita
8,646,435 B2 2/2014 Dibble et al.
8,701,628 B2 4/2014 Tripathi et al.
8,706,383 B2 * 4/2014 Sauve ..... F02D 41/0025 123/434
8,833,058 B2 9/2014 Ervin et al.
8,833,345 B2 9/2014 Pochner et al.
8,869,773 B2 10/2014 Tripathi et al.
8,979,708 B2 3/2015 Burtch
9,140,622 B2 9/2015 Beikmann
9,222,427 B2 12/2015 Matthews et al.
2001/0007964 A1 7/2001 Poljansek et al.
2002/0156568 A1 10/2002 Knott et al.
2002/0162540 A1 11/2002 Matthews et al.
2002/0189574 A1 * 12/2002 Kim ..... F01L 13/0005 123/198 F
2003/0116130 A1 6/2003 Kisaka et al.
2003/0123467 A1 7/2003 Du et al.
2003/0131820 A1 * 7/2003 Mckay ..... F01L 13/0005 123/198 F
2003/0172900 A1 9/2003 Boyer et al.
2004/0007211 A1 1/2004 Kobayashi
2004/0034460 A1 2/2004 Folkerts et al.
2004/0069290 A1 4/2004 Bucktron et al.
2004/0129249 A1 7/2004 Kondo
2004/0206072 A1 10/2004 Surnilla et al.
2005/0016492 A1 1/2005 Matthews
2005/0056250 A1 3/2005 Stroh
2005/0098156 A1 5/2005 Ohtani
2005/0131618 A1 6/2005 Megli et al.
2005/0197761 A1 9/2005 Bidner et al.
2005/0199220 A1 9/2005 Ogiso
2005/0204726 A1 9/2005 Lewis
2005/0204727 A1 9/2005 Lewis et al.
2005/0205028 A1 9/2005 Lewis et al.
2005/0205045 A1 9/2005 Michelini et al.

(56) References Cited

U.S. PATENT DOCUMENTS

| | | | |
|---|---|---|---|
| 2005/0205060 | A1 | 9/2005 | Michelini et al. |
| 2005/0205063 | A1 | 9/2005 | Kolmanovsky et al. |
| 2005/0205069 | A1 | 9/2005 | Lewis et al. |
| 2005/0205074 | A1 | 9/2005 | Gibson et al. |
| 2005/0235743 | A1 | 10/2005 | Stempnik et al. |
| 2006/0107919 | A1 | 5/2006 | Nishi et al. |
| 2006/0112918 | A1 | 6/2006 | Persson |
| 2006/0130814 | A1 | 6/2006 | Bolander et al. |
| 2006/0178802 | A1 | 8/2006 | Bolander et al. |
| 2007/0012040 | A1 | 1/2007 | Nitzke et al. |
| 2007/0042861 | A1 | 2/2007 | Takaoka et al. |
| 2007/0100534 | A1 | 5/2007 | Katsumata |
| 2007/0101969 | A1 | 5/2007 | Lay et al. |
| 2007/0107692 | A1 | 5/2007 | Kuo et al. |
| 2007/0131169 | A1 | 6/2007 | Ahn |
| 2007/0131196 | A1 | 6/2007 | Gibson et al. |
| 2007/0135988 | A1 | 6/2007 | Kidston et al. |
| 2007/0235005 | A1 | 10/2007 | Lewis |
| 2008/0000149 | A1 | 1/2008 | Aradi |
| 2008/0041327 | A1 | 2/2008 | Lewis et al. |
| 2008/0066699 | A1 | 3/2008 | Michelini et al. |
| 2008/0121211 | A1 | 5/2008 | Livshiz et al. |
| 2008/0154468 | A1 | 6/2008 | Berger et al. |
| 2008/0254926 | A1 | 10/2008 | Schuseil et al. |
| 2008/0262698 | A1 | 10/2008 | Lahti et al. |
| 2008/0288146 | A1 | 11/2008 | Beechie et al. |
| 2009/0007877 | A1 | 1/2009 | Raiford |
| 2009/0013667 | A1 | 1/2009 | Winstead |
| 2009/0013668 | A1 | 1/2009 | Winstead |
| 2009/0013669 | A1 | 1/2009 | Winstead |
| 2009/0013969 | A1 | 1/2009 | Winstead |
| 2009/0030594 | A1 | 1/2009 | You et al. |
| 2009/0042458 | A1 | 2/2009 | Kinoshita |
| 2009/0118914 | A1 | 5/2009 | Schwenke et al. |
| 2009/0118975 | A1 | 5/2009 | Murakami et al. |
| 2009/0118986 | A1 | 5/2009 | Kita |
| 2009/0177371 | A1 | 7/2009 | Reinke |
| 2009/0204312 | A1 | 8/2009 | Moriya |
| 2009/0241872 | A1 | 10/2009 | Wang et al. |
| 2009/0248277 | A1 | 10/2009 | Shinagawa et al. |
| 2009/0248278 | A1 | 10/2009 | Nakasaka |
| 2009/0292435 | A1 | 11/2009 | Costin et al. |
| 2010/0006065 | A1 | 1/2010 | Tripathi et al. |
| 2010/0010724 | A1 | 1/2010 | Tripathi et al. |
| 2010/0012072 | A1 | 1/2010 | Leone et al. |
| 2010/0030447 | A1 | 2/2010 | Smyth et al. |
| 2010/0036571 | A1 | 2/2010 | Han et al. |
| 2010/0050993 | A1 | 3/2010 | Zhao et al. |
| 2010/0059004 | A1 | 3/2010 | Gill |
| 2010/0100299 | A1 | 4/2010 | Tripathi et al. |
| 2010/0107630 | A1 | 5/2010 | Hamama et al. |
| 2010/0211299 | A1 | 8/2010 | Lewis et al. |
| 2010/0282202 | A1 | 11/2010 | Luken |
| 2010/0318275 | A1 | 12/2010 | Borchsenius et al. |
| 2011/0030657 | A1 | 2/2011 | Tripathi et al. |
| 2011/0048372 | A1 | 3/2011 | Dibble et al. |
| 2011/0094475 | A1 | 4/2011 | Riegel et al. |
| 2011/0107986 | A1 | 5/2011 | Winstead |
| 2011/0144883 | A1 | 6/2011 | Rollinger et al. |
| 2011/0208405 | A1 | 8/2011 | Tripathi et al. |
| 2011/0213540 | A1 | 9/2011 | Tripathi et al. |
| 2011/0213541 | A1 | 9/2011 | Tripathi et al. |
| 2011/0251773 | A1 | 10/2011 | Sahandiesfanjani et al. |
| 2011/0264342 | A1 | 10/2011 | Baur et al. |
| 2011/0265454 | A1 | 11/2011 | Smith et al. |
| 2011/0265771 | A1 | 11/2011 | Banker et al. |
| 2011/0295483 | A1 | 12/2011 | Ma et al. |
| 2011/0313643 | A1 | 12/2011 | Lucatello et al. |
| 2012/0029787 | A1 | 2/2012 | Whitney et al. |
| 2012/0055444 | A1 | 3/2012 | Tobergte et al. |
| 2012/0103312 | A1 | 5/2012 | Sasai et al. |
| 2012/0109495 | A1 | 5/2012 | Tripathi et al. |
| 2012/0116647 | A1 | 5/2012 | Pochner et al. |
| 2012/0143471 | A1 | 6/2012 | Tripathi et al. |
| 2012/0180759 | A1 | 7/2012 | Whitney et al. |
| 2012/0221217 | A1 | 8/2012 | Sujan et al. |
| 2012/0285161 | A1 | 11/2012 | Kerns et al. |
| 2013/0092127 | A1 | 4/2013 | Pirjaberi et al. |
| 2013/0092128 | A1 | 4/2013 | Pirjaberi et al. |
| 2013/0184949 | A1* | 7/2013 | Saito ..... B60W 10/11 701/58 |
| 2013/0289853 | A1 | 10/2013 | Serrano |
| 2014/0041625 | A1 | 2/2014 | Pirjaberi et al. |
| 2014/0041641 | A1 | 2/2014 | Carlson et al. |
| 2014/0053802 | A1 | 2/2014 | Rayl |
| 2014/0053803 | A1 | 2/2014 | Rayl |
| 2014/0053804 | A1 | 2/2014 | Rayl et al. |
| 2014/0053805 | A1 | 2/2014 | Brennan et al. |
| 2014/0069178 | A1 | 3/2014 | Beikmann |
| 2014/0069374 | A1 | 3/2014 | Matthews |
| 2014/0069375 | A1 | 3/2014 | Matthews et al. |
| 2014/0069376 | A1 | 3/2014 | Matthews et al. |
| 2014/0069377 | A1 | 3/2014 | Brennan et al. |
| 2014/0069378 | A1 | 3/2014 | Burleigh et al. |
| 2014/0069379 | A1 | 3/2014 | Beikmann |
| 2014/0069381 | A1 | 3/2014 | Beikmann |
| 2014/0090623 | A1 | 4/2014 | Beikmann |
| 2014/0090624 | A1 | 4/2014 | Verner |
| 2014/0102411 | A1 | 4/2014 | Brennan |
| 2014/0190448 | A1 | 7/2014 | Brennan et al. |
| 2014/0190449 | A1 | 7/2014 | Phillips |
| 2014/0194247 | A1 | 7/2014 | Burtch |
| 2014/0207359 | A1 | 7/2014 | Phillips |
| 2015/0240671 | A1 | 8/2015 | Nakamura |
| 2015/0260112 | A1 | 9/2015 | Liu et al. |
| 2015/0260117 | A1* | 9/2015 | Shost ..... F02D 41/0087 123/481 |
| 2015/0354470 | A1 | 12/2015 | Li et al. |

FOREIGN PATENT DOCUMENTS

| | | | |
|---|---|---|---|
| CN | 101353992 | A | 1/2009 |
| CN | 101586504 | A | 11/2009 |
| CN | 102454493 | A | 5/2012 |
| JP | 2011149352 | | 8/2011 |

OTHER PUBLICATIONS

International Search Report and Written Opinion dated Jun. 17, 2015 corresponding to International Application No. PCT/US2015/019496, 14 pages.
U.S. Appl. No. 13/798,351, filed Mar. 13, 2013, Rayl.
U.S. Appl. No. 13/798,384, filed Mar. 13, 2013, Burtch.
U.S. Appl. No. 13/798,400, filed Mar. 13, 2013, Phillips.
U.S. Appl. No. 13/798,435, filed Mar. 13, 2013, Matthews.
U.S. Appl. No. 13/798,451, filed Mar. 13, 2013, Rayl.
U.S. Appl. No. 13/798,471, filed Mar. 13, 2013, Matthews et al.
U.S. Appl. No. 13/798,518, filed Mar. 13, 2013, Beikmann.
U.S. Appl. No. 13/798,536, filed Mar. 13, 2013, Matthews et al.
U.S. Appl. No. 13/798,540, filed Mar. 13, 2013, Brennan et al.
U.S. Appl. No. 13/798,574, filed Mar. 13, 2013, Verner.
U.S. Appl. No. 13/798,586, filed Mar. 13, 2013, Rayl et al.
U.S. Appl. No. 13/798,590, filed Mar. 13, 2013, Brennan et al.
U.S. Appl. No. 13/798,624, filed Mar. 13, 2013, Brennan et al.
U.S. Appl. No. 13/798,701, filed Mar. 13, 2013, Burleigh et al.
U.S. Appl. No. 13/798,737, filed Mar. 13, 2013, Beikmann.
U.S. Appl. No. 13/798,775, filed Mar. 13, 2013, Phillips.
U.S. Appl. No. 13/799,116, filed Mar. 13, 2013, Brennan.
U.S. Appl. No. 13/799,129, filed Mar. 13, 2013, Beikmann.
U.S. Appl. No. 13/799,181, filed Mar. 13, 2013, Beikmann.
U.S. Appl. No. 14/211,389, filed Mar. 14, 2014, Liu et al.
U.S. Appl. No. 14/300,469, filed Jun. 10, 2014, Li et al.
U.S. Appl. No. 14/310,063, filed Jun. 20, 2014, Wagh et al.
U.S. Appl. No. 14/548,501, filed Nov. 20, 2014, Beikmann et al.
U.S. Appl. No. 61/952,737, filed Mar. 13, 2014, Shost et al.

* cited by examiner

FUEL CONSUMPTION BASED CYLINDER ACTIVATION AND DEACTIVATION CONTROL SYSTEMS AND METHODS

CROSS-REFERENCE TO RELATED APPLICATIONS

This application claims the benefit of U.S. Provisional Application No. 62/011,286, filed on Jun. 12, 2014. The disclosure of the above application is incorporated herein by reference in its entirety.

FIELD

The present disclosure relates to internal combustion engines and more specifically to cylinder activation and deactivation control systems and methods.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. In some types of engines, air flow into the engine may be regulated via a throttle. The throttle may adjust throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders generally increases the torque output of the engine.

Under some circumstances, one or more cylinders of an engine may be deactivated. Deactivation of a cylinder may include deactivating opening and closing of intake and exhaust valves of the cylinder and halting fueling of the cylinder. One or more cylinders may be deactivated, for example, to decrease fuel consumption when the engine can produce a requested amount of torque while the one or more cylinders are deactivated.

SUMMARY

In a feature, a cylinder control system for a vehicle is disclosed. A torque request module generates a torque request for an engine based on at least one driver input. A firing fraction module, based on the torque request, determines a target number of activated cylinders of the engine. A sequence module determines possible sequences for activating and deactivating cylinders of the engine to achieve the target number of activated cylinders. A fueling module determines predicted fuel consumption values for the possible sequences, respectively. An identification module identifies first ones of the possible sequences having predicted fuel consumption values that are less than a predetermined amount from a lowest one of the predicted fuel consumption values. A selection module selects one of the first ones of the possible sequences and sets a selected sequence for activating and deactivating cylinders of the engine to the selected one of the first ones of the possible sequences. A command module, based on the selected sequence, commands one of activation and deactivation of a next cylinder in a predetermined firing order of the cylinders and one of activates and deactivates the next cylinder based on the command.

In further features, the fueling module determines the predicted fuel consumption values for the possible sequences based on the sequences for activating and deactivating cylinders of the possible sequences, respectively.

In further features, the fueling module determines the predicted fuel consumption values further based on one or more cylinder activation/deactivation states of one or more previous cylinders, respectively, in the predetermined firing order of the cylinders.

In further features, the fueling module determines the predicted fuel consumption values further based on an engine speed.

In further features, the fueling module determines the predicted fuel consumption values further based on an engine load.

In further features, the fueling module determines the predicted fuel consumption values for the possible sequences based on the sequences for activating and deactivating cylinders of the possible sequences, respectively, an engine speed, and an engine load.

In further features, an accessory disturbance module determines accessory disturbance values for the first ones of the possible sequences, respectively, and the selection module selects one of the first ones of the possible sequences having a lowest accessory disturbance value.

In further features, a torsion module determines crankshaft torsional vibration values for the first ones of the possible sequences, respectively, and the selection module selects one of the first ones of the possible sequences having a lowest crankshaft torsional vibration value.

In further features, a seat acceleration module determines an acceleration at a seat track within a passenger cabin of the vehicle for the first ones of the possible sequences, respectively, and the selection module selects one of the first ones of the possible sequences having a lowest acceleration.

In further features, the identification module further identifies second ones of the possible sequences having predicted fuel consumption values that are greater than the predetermined amount from the lowest one of the predicted fuel consumption values and prevents the selection module from selecting the second ones of the possible sequences.

In a feature, a cylinder control method for a vehicle is disclosed. The cylinder control method includes: generating a torque request for an engine based on at least one driver input; based on the torque request, determining a target number of activated cylinders of the engine; determining possible sequences for activating and deactivating cylinders of the engine to achieve the target number of activated cylinders; determining predicted fuel consumption values for the possible sequences, respectively; identifying first ones of the possible sequences having predicted fuel consumption values that are less than a predetermined amount from a lowest one of the predicted fuel consumption values; selecting one of the first ones of the possible sequences; setting a selected sequence for activating and deactivating cylinders of the engine to the selected one of the first ones of the possible sequences; based on the selected sequence, commanding one of activation and deactivation of a next cylinder in a predetermined firing order of the cylinders; and one of activating and deactivating the next cylinder based on the command.

In further features, the cylinder control method further includes determining the predicted fuel consumption values for the possible sequences based on the sequences for activating and deactivating cylinders of the possible sequences, respectively.

In further features, the cylinder control method further includes determining the predicted fuel consumption values further based on one or more cylinder activation/deactivation states of one or more previous cylinders, respectively, in the predetermined firing order of the cylinders.

In further features, the cylinder control method further includes determining the predicted fuel consumption values further based on an engine speed.

In further features, the cylinder control method further includes determining the predicted fuel consumption values further based on an engine load.

In further features, the cylinder control method further includes determining the predicted fuel consumption values for the possible sequences based on the sequences for activating and deactivating cylinders of the possible sequences, respectively, an engine speed, and an engine load.

In further features, the cylinder control method further includes: determining accessory disturbance values for the first ones of the possible sequences, respectively; and selecting one of the first ones of the possible sequences having a lowest accessory disturbance value.

In further features, the cylinder control method further includes: determining crankshaft torsional vibration values for the first ones of the possible sequences, respectively; and selecting one of the first ones of the possible sequences having a lowest crankshaft torsional vibration value.

In further features, the cylinder control method further includes: determining an acceleration at a seat track within a passenger cabin of the vehicle for the first ones of the possible sequences, respectively; and selecting one of the first ones of the possible sequences having a lowest acceleration.

In further features, the cylinder control method further includes: identifying second ones of the possible sequences having predicted fuel consumption values that are greater than the predetermined amount from the lowest one of the predicted fuel consumption values; and preventing the selection of the second ones of the possible sequences.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Internal combustion engines combust an air and fuel mixture within cylinders to generate torque. Under some circumstances, an engine control module (ECM) may deactivate one or more cylinders of the engine. The ECM may deactivate one or more cylinders, for example, to decrease fuel consumption.

The ECM determines a target firing fraction for the cylinders of the engine based on an engine torque request. A numerator of the target firing fraction may indicate how many cylinders to activate during the next X number of cylinders in a firing order of the cylinders, where X is the denominator of the target firing fraction.

The ECM determines possible sequences of activated cylinders that can be used to achieve the target firing fraction. Different sequences of activated cylinders may provide different volumetric efficiencies for each cylinder and, therefore, fuel consumption values. According to the present disclosure, the ECM determines a fuel consumption for possible sequences identified to achieve the target firing fraction. The ECM identifies the possible sequence having a lowest fuel consumption value and possible sequences having fuel consumption values that are within a predetermined range of the lowest fuel consumption value. The ECM discards possible sequences having fuel consumption values that are higher than the range.

The ECM selects one of the (non-discarded) possible sequences and controls the activation and deactivation of cylinders based on the selected possible sequence. For example, the ECM may select the one of the possible sequences that minimizes seat track acceleration, crankshaft torsional vibration, and/or accessory drive disturbances.

Figure 1:
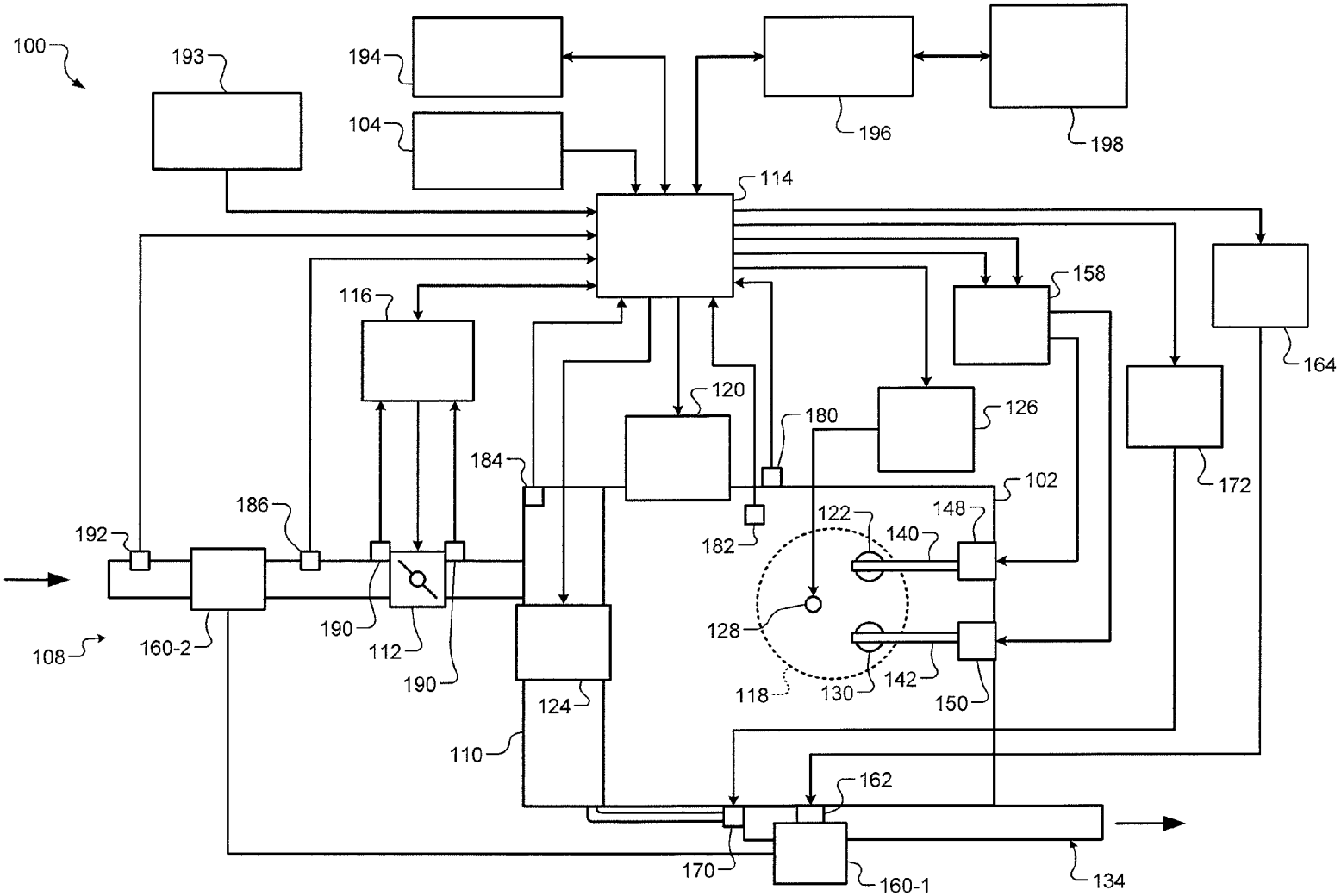
FIG. 1 is a functional block diagram of an example engine system.

Referring now to FIG. 1, a functional block diagram of an example engine system 100 is presented. The engine system 100 of a vehicle includes an engine 102 that combusts an air/fuel mixture to produce torque based on driver input from a driver input module 104. Air is drawn into the engine 102 through an intake system 108. The intake system 108 may include an intake manifold 110 and a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control airflow into the intake manifold 110.

Air from the intake manifold 110 is drawn into cylinders of the engine 102. While the engine 102 includes multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders under some circumstances, as discussed further below, which may improve fuel efficiency.

The engine 102 may operate using a four-stroke cycle or another suitable engine cycle. The four strokes of a four-stroke cycle, described below, will be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes. For four-stroke engines, one engine cycle may correspond to two crankshaft revolutions.

When the cylinder 118 is activated, air from the intake manifold 110 is drawn into the cylinder 118 through an intake valve 122 during the intake stroke. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which will be referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may halt provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time at which the piston returns to a bottom most position, which will be referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). While camshaft based valve actuation is shown and has been discussed, camless valve actuators may be implemented. While separate intake and exhaust camshafts are shown, one camshaft having lobes for both the intake and exhaust valves may be used.

The cylinder actuator module 120 may deactivate the cylinder 118 by disabling opening of the intake valve 122 and/or the exhaust valve 130. The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158. In various other implementations, the intake valve 122 and/or the exhaust valve 130 may be controlled by actuators other than a camshaft, such as electromechanical actuators, electrohydraulic actuators, electromagnetic actuators, etc.

The engine system 100 may include a boost device that provides pressurized air to the intake manifold 110. For example, FIG. 1 shows a turbocharger including a turbine 160-1 that is driven by exhaust gases flowing through the exhaust system 134. The turbocharger also includes a compressor 160-2 that is driven by the turbine 160-1 and that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. Although shown separated for purposes of illustration, the turbine 160-1 and the compressor 160-2 may be mechanically linked to each other, placing intake air in close proximity to hot exhaust. The compressed air charge may absorb heat from components of the exhaust system 134.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

Crankshaft position may be measured using a crankshaft position sensor 180. An engine speed may be determined based on the crankshaft position measured using the crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192. The engine system 100 may also include one or more other sensors 193. The ECM 114 may use signals from the sensors to make control decisions for the engine system 100.

The ECM 114 may communicate with a transmission control module 194, for example, to coordinate shifting gears in the transmission. For example, the ECM 114 may reduce engine torque during a gear shift. The ECM 114 may communicate with a hybrid control module 196, for example, to coordinate operation of the engine 102 and an electric motor 198. The electric motor 198 may also function as a generator, and may be used to produce electrical energy for use by vehicle electrical systems and/or for storage in a battery. While only the electric motor 198 is shown and discussed, multiple electric motors may be implemented. In various implementations, various functions of the ECM 114, the transmission control module 194, and the hybrid control module 196 may be integrated into one or more modules.

Each system that varies an engine parameter may be referred to as an engine actuator. Each engine actuator has an associated actuator value. For example, the throttle actuator module 116 may be referred to as an engine actuator, and the throttle opening area may be referred to as the actuator value. In the example of FIG. 1, the throttle actuator module 116 achieves the throttle opening area by adjusting an angle of the blade of the throttle valve 112.

The spark actuator module 126 may also be referred to as an engine actuator, while the corresponding actuator value may be the amount of spark advance relative to cylinder TDC. Other engine actuators may include the cylinder actuator module 120, the fuel actuator module 124, the phaser actuator module 158, the boost actuator module 164, and the EGR actuator module 172. For these engine actuators, the actuator values may correspond to a cylinder activation/deactivation sequence, fueling rate, intake and exhaust cam phaser angles, boost pressure, and EGR valve opening area, respectively. The ECM 114 may control the actuator values in order to cause the engine 102 to generate a requested engine output torque.

Figure 2:
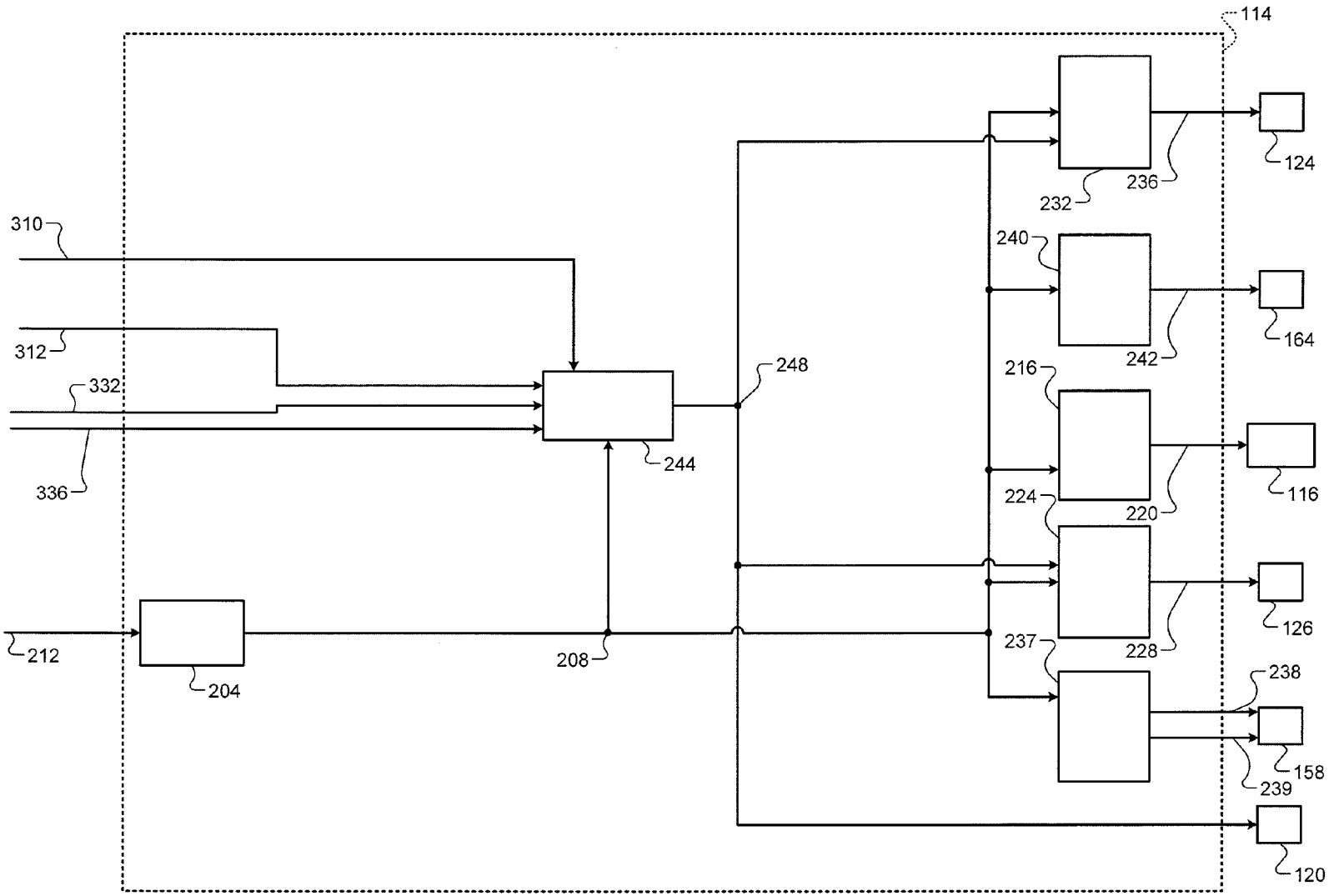
FIG. 2 is a functional block diagram of an example engine control system.

Referring now to FIG. 2, a functional block diagram of an example engine control system is presented. A torque request module 204 determines a torque request 208 for the engine 102 based on one or more driver inputs 212. The driver inputs 212 may include, for example, an accelerator pedal position, a brake pedal position, a cruise control input, and/or one or more other suitable driver inputs. The torque request module 204 may determine the torque request 208 additionally or alternatively based on one or more other torque requests, such as torque requests generated by the ECM 114 and/or torque requests received from other modules of the vehicle, such as the transmission control module 194, the hybrid control module 196, a chassis control module, etc.

One or more engine actuators are controlled based on the torque request 208 and/or one or more other parameters. For example, a throttle control module 216 may determine a target throttle opening 220 based on the torque request 208. The throttle actuator module 116 may adjust opening of the throttle valve 112 based on the target throttle opening 220.

A spark control module 224 determines a target spark timing 228 based on the torque request 208. The spark actuator module 126 generates spark based on the target spark timing 228. A fuel control module 232 determines one or more target fueling parameters 236 based on the torque request 208. For example, the target fueling parameters 236 may include fuel injection amount, number of fuel injections for injecting the amount, and timing for each of the injections. The fuel actuator module 124 injects fuel based on the target fueling parameters 236.

A phaser control module 237 determines target intake and exhaust cam phaser angles 238 and 239 based on the torque request 208. The phaser actuator module 158 may regulate the intake and exhaust cam phasers 148 and 150 based on the target intake and exhaust cam phaser angles 238 and 239, respectively. A boost control module 240 may determine a target boost 242 based on the torque request 208. The boost actuator module 164 may control boost output by the boost device(s) based on the target boost 242.

A cylinder control module 244 generates a firing command 248 for a next cylinder in a predetermined firing order of the cylinders ("the next cylinder"). The firing command 248 indicates whether the next cylinder should be activated or deactivated. For example only, the cylinder control module 244 may set the firing command 248 to a first state (e.g., 1) when the next cylinder should be activated and set the firing command 248 to a second state (e.g., 0) when the next cylinder should be deactivated. While the firing command 248 is and will be discussed with respect to the next cylinder in the predetermined firing order, the firing command 248 may be generated for a second cylinder immediately following the next cylinder in the predetermined firing order, a third cylinder immediately following the second cylinder in the predetermined firing order, or another cylinder following the next cylinder in the predetermined firing order.

The cylinder actuator module 120 deactivates the intake and exhaust valves of the next cylinder when the firing command 248 indicates that the next cylinder should be deactivated. The cylinder actuator module 120 allows opening and closing of the intake and exhaust valves of the next cylinder when the firing command 248 indicates that the next cylinder should be activated.

The fuel control module 232 halts fueling of the next cylinder when the firing command 248 indicates that the next cylinder should be deactivated. The fuel control module 232 sets the target fueling parameters 236 to provide fuel to the next cylinder when the firing command 248 indicates that the next cylinder should be activated. The spark control module 224 may provide spark to the next cylinder when the firing command 248 indicates that the next cylinder should be activated. The spark control module 224 may provide or halt spark to the next cylinder when the firing command 248 indicates that the next cylinder should be deactivated. Cylinder deactivation is different than fuel cutoff (e.g., deceleration fuel cutoff) in that the intake and exhaust valves of cylinders to which fueling is halted during fuel cutoff may still be opened and closed during fuel cutoff whereas the intake and exhaust valves of cylinders are maintained closed when those cylinders are deactivated.

Figure 3:
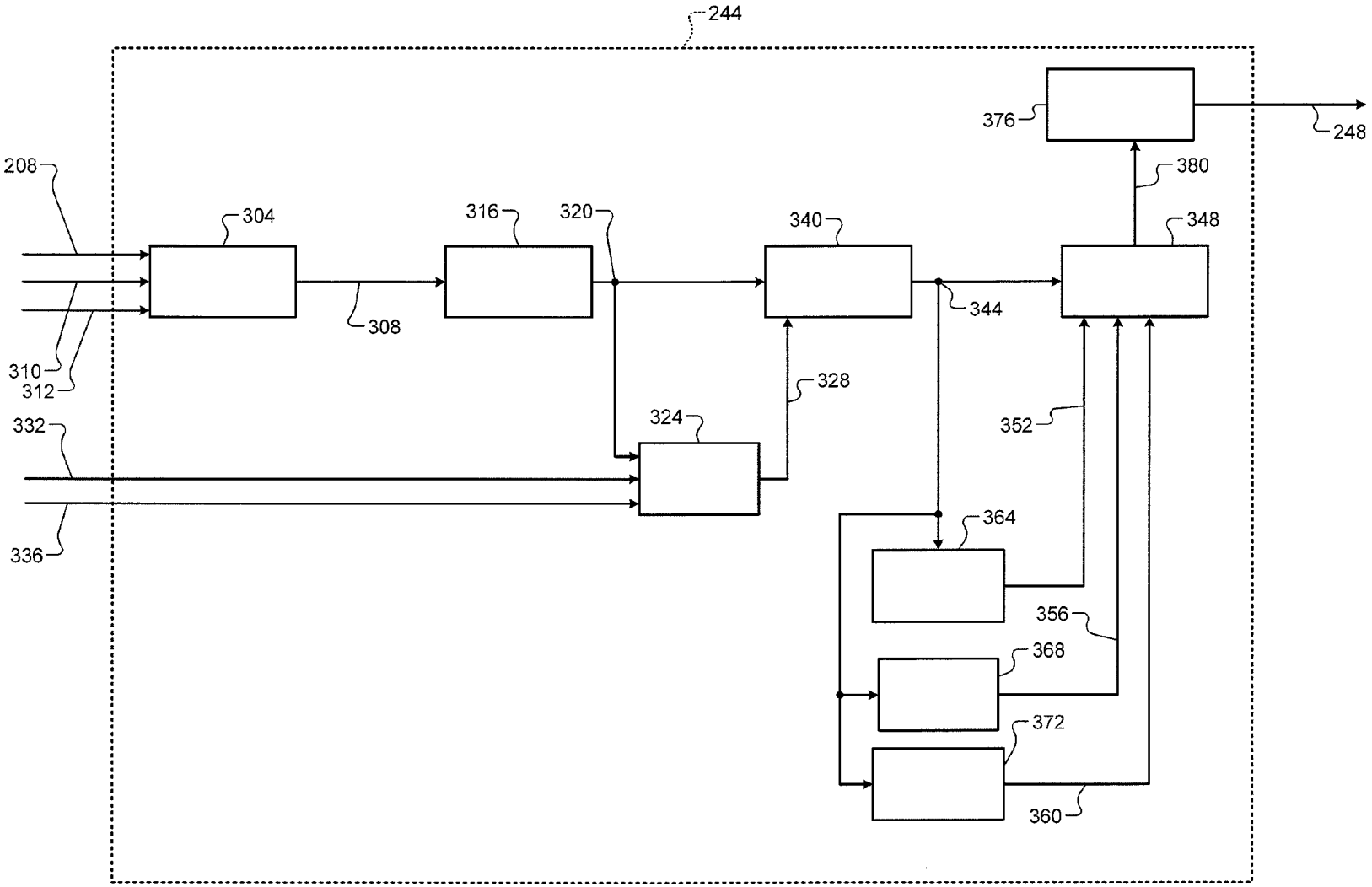
FIG. 3 is a functional block diagram of an example cylinder control module.

FIG. 3 is a functional block diagram of an example implementation of the cylinder control module 244. A firing fraction module 304 determines a target firing fraction 308. The target firing fraction 308 corresponds to a target number of cylinders to be activated out of the next N cylinders in the predetermined firing order of the cylinders. N is an integer that is greater than or equal to the target number of cylinders. For example, the target firing fraction may be a fraction between 0 and 1, inclusive. A target firing fraction of 0 corresponds to all of the cylinders of the engine 102 being deactivated (and 0 being activated), and a target firing fraction of 1 corresponds to all of the cylinders of the engine 102 being activated (and 0 being deactivated). A target firing fraction between 0 and 1 corresponds to less than all of the cylinders being activated during the next N cylinders in the predetermined firing order.

The firing fraction module 304 determines the target firing fraction 308 based on the torque request 208. The firing fraction module 304 may determine the target firing fraction 308 further based on one or more other parameters, such as a current gear ratio 310 of the transmission and/or a vehicle speed 312. For example, the firing fraction module 304 may determine the target firing fraction 308 using one of a function and a mapping that relates the torque request 208, the gear ratio 310, and the vehicle speed 312 to the target firing fraction 308.

A sequence module 316 determines possible sequences 320 for activating and deactivating cylinders to achieve the target firing fraction 308. The possible sequences 320 for each possible value of the target firing fraction 308 may be identified during calibration and stored, for example, in memory. The sequence module 316 determines the possible sequences 320 stored for the target firing fraction 308.

Each of the possible sequences 320 for a given target firing fraction includes a sequence of a plurality of entries for activating and deactivating cylinders to achieve that target firing fraction. For example, a possible sequence for achieving a target firing fraction of 5/8 may be

[1, 0, 1, 1, 0, 1, 0, 1], where a 1 indicates an activated cylinder and a 0 indicates a deactivated cylinder. Other possible sequences for achieving a target firing fraction of 5/8 include, but are not limited to:

[1, 1, 0, 1, 0, 1, 0, 1],

[1, 0, 0, 1, 1, 0, 1, 1], and

[0, 1, 1, 0, 1, 1, 0, 1].

Multiple possible sequences may be stored for each possible target firing fraction. Exceptions where only 1 possible sequence may be stored include target firing fractions of 0 and 1, where zero and all cylinders are activated.

A fueling module 324 determines fuel consumption values 328 for the possible sequences 320, respectively, based on the possible sequences 320, respectively, an engine speed 332, and an engine load 336. The fuel consumption value 328 for a possible sequence corresponds to a predicted brake specific fuel consumption (BSFC) for use of that possible sequence at the engine speed 332 and the engine load 336.

The fueling module 324 may determine the fuel consumption values using one of a function and a mapping that relates possible sequence, the engine speed 332, and the engine load 336 to fuel consumption value. The engine speed 332 may be determined, for example, based on crankshaft position measured using the crankshaft position sensor 180. The engine load 336 may correspond to a ratio of a current output of the engine 102 and a maximum output of the engine 102 and may be determined, for example, based on a MAF into the engine 102 and/or a MAP. The fueling module 324 may determine the fuel consumption values further based on one or more other parameters, such as whether one or more cylinders before the next cylinder in the predetermined firing order were activated or deactivated.

The fuel consumption values 328 are proportional to volumetric efficiencies of the engine 102 for use of the possible sequences 320. Due to differences in the intake system through which air flows into the cylinders, activation of different sets of cylinders provide different volumetric efficiencies. While the present disclosure will be discussed in terms of minimizing fuel consumption, maximizing volumetric efficiency may be used. Additionally or alternatively, minimizing variation on volumetric efficiency between cylinders may be used. For example, a possible sequence producing a lower variation between the volumetric efficiencies of the activated cylinders in that sequence may be selected over a possible sequence producing a higher variation between the volumetric efficiencies of the activated cylinders in that sequence.

Figure 4:
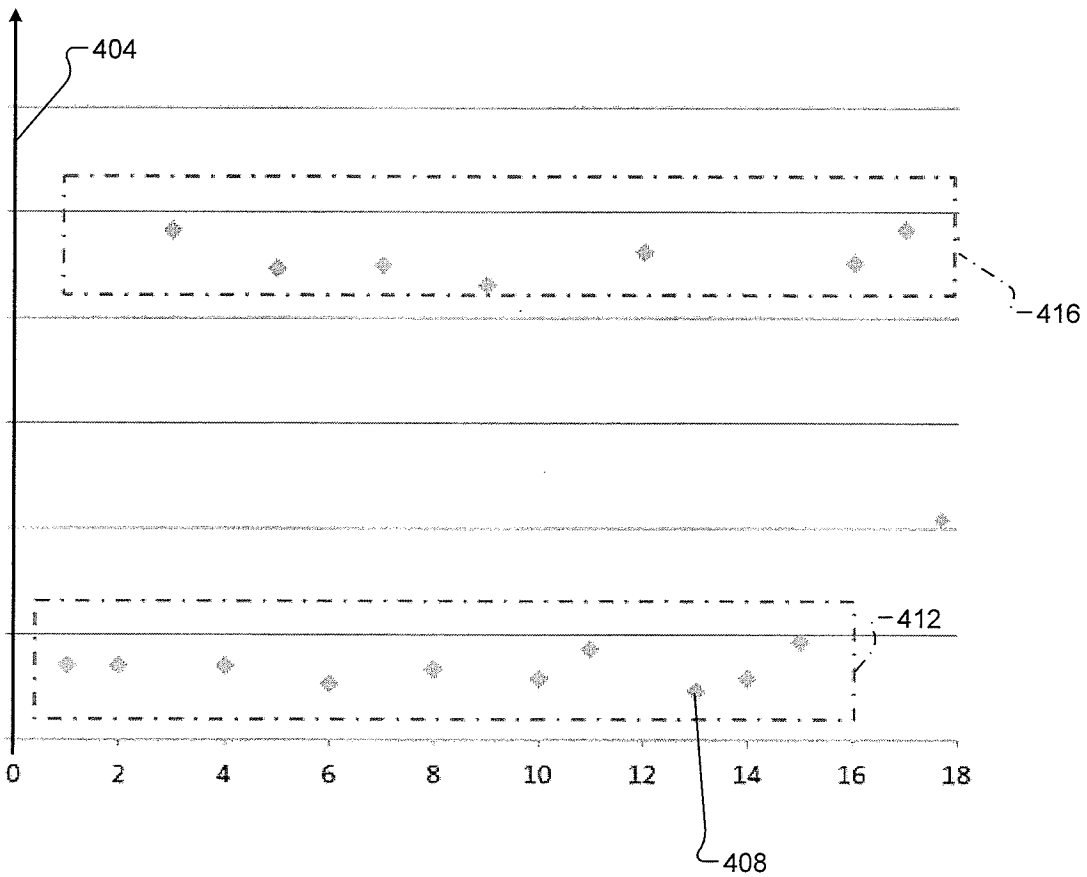
FIG. 4 is an example graph of fuel consumption for a plurality of possible sequences of activating and deactivating cylinders in a predetermined firing order.

FIG. 4 includes an example graph of fuel consumption values 404 determined for a plurality of possible sequences for activating 5 out of 8 cylinders of an 8 cylinder engine at an engine speed and engine load. Diamonds indicate fuel consumption values for the possible sequences, respectively. In the example of FIG. 4, 18 different possible sequences for activating 5 out of 8 cylinders were used.

Referring back to FIG. 3, an identification module 340 identifies a lowest one of the fuel consumption values 328 determined for the possible sequences 320, respectively. For example, the identification module 340 may identify the lowest one of the fuel consumption values 328 using a minimum function.

The identification module 340 outputs ones of the possible sequences 320 having fuel consumption values 328 that are within a predetermined amount or percentage of the lowest one of the fuel consumption values 328. The ones of the possible sequences 320 having fuel consumption values 328 that are within the predetermined amount or percentage of the lowest one of the fuel consumption values 328 will be referred to as identified possible sequences 344.

The identification module 340 discards ones of the possible sequences 320 having fuel consumption values 328 that are not within the predetermined amount or percentage of the lowest one of the fuel consumption values 328. In this manner, the ones of the possible sequences 320 having fuel consumption values 328 that are not within the predetermined amount or percentage of the lowest one of the fuel consumption values 328 are not used to generate the firing command 248.

In FIG. 4, the lowest one of the fuel consumption values is indicated by diamond 408. Dashed box 412 encircles the fuel consumption values that are within the predetermined amount or percentage of the lowest one of the fuel consumption values. The possible sequences associated with the fuel consumption values within the dashed box 412 would therefore be the identified possible sequences 344.

Dashed box 416 encircles fuel consumption values that are not within the predetermined amount or percentage of the lowest one of the fuel consumption values. Possible sequences associated with the fuel consumption values within the dashed box 416 would therefore not be selected for use in controlling activation or deactivation of the next cylinder.

A selection module 348 selects one of the identified possible sequences 344 and generates the firing command 248 for the next cylinder in the predetermined firing order based on the selected one of the identified possible sequences 344. The selection module 348 may select one of the identified possible sequences 344, for example, based on accessory drive system disturbance values 352 determined for the identified possible sequences 344, respectively, torsion values 356 determined for the identified possible sequences 344, respectively, and/or seat track acceleration values 360 determined for the identified possible sequences 344, respectively.

An accessory disturbance module 364 determines the accessory drive system disturbance values 352 for the identified possible sequences 344, respectively. The accessory drive system disturbance values 352 may correspond to, for example, predicted changes in speed and/or acceleration in one or more components of a drive system (e.g., accessory drive belt) of accessories of the vehicle for use of the identified possible sequences 344, respectively. The accessory disturbance module 364 may determine the accessory drive system disturbance values 352, for example, using one of a function and a mapping that relates filtered possible sequence to accessory drive system disturbance value.

A torsion module 368 determines the torsion values 356 for the identified possible sequences 344, respectively. The torsion values 356 may correspond to, for example, predicted torsional vibration of the crankshaft for use of the identified possible sequences 344, respectively. The torsion module 368 may determine the torsion values 356, for example, using one of a function and a mapping that relates filtered possible sequence to torsion value.

A seat acceleration module 372 determines the seat track acceleration values 360 for the identified possible sequences 344, respectively. The seat track acceleration values 360 may correspond to, for example, predicted acceleration in one or more directions at a seat track within a passenger cabin of the vehicle for use of the identified possible sequences 344, respectively. The seat acceleration module 372 may determine the seat track acceleration values 360, for example, using one of a function and a mapping that relates filtered possible sequence to seat track acceleration value.

As stated above, the selection module 348 may select one of the identified possible sequences 344, for example, based on the accessory drive system disturbance values 352, the torsion values 356, and/or the seat track acceleration values 360 determined for the identified possible sequences 344, respectively. For example, the selection module 348 may select the one of the identified possible sequences 344 that best minimizes accessory drive disturbances, torsion, and/or seat track acceleration. Alternatively, the selection module 348 may select the one of the identified possible sequences 344 having the minimum one of the fuel consumption values 328.

The selection module 348 outputs the selected one of the identified possible sequences 344 to a command module 376. The selected one of the identified possible sequences 344 will be referred to as a selected target sequence 380. The command module 376 sets the firing command 248 for the next cylinder in the predetermined firing order to the first entry in the selected target sequence 380. The cylinder actuator module 120 activates or deactivates the next cylinder in the predetermined firing order based on the firing command 248. The fuel control module 232 disables fueling of deactivated cylinders.

Figure 5:
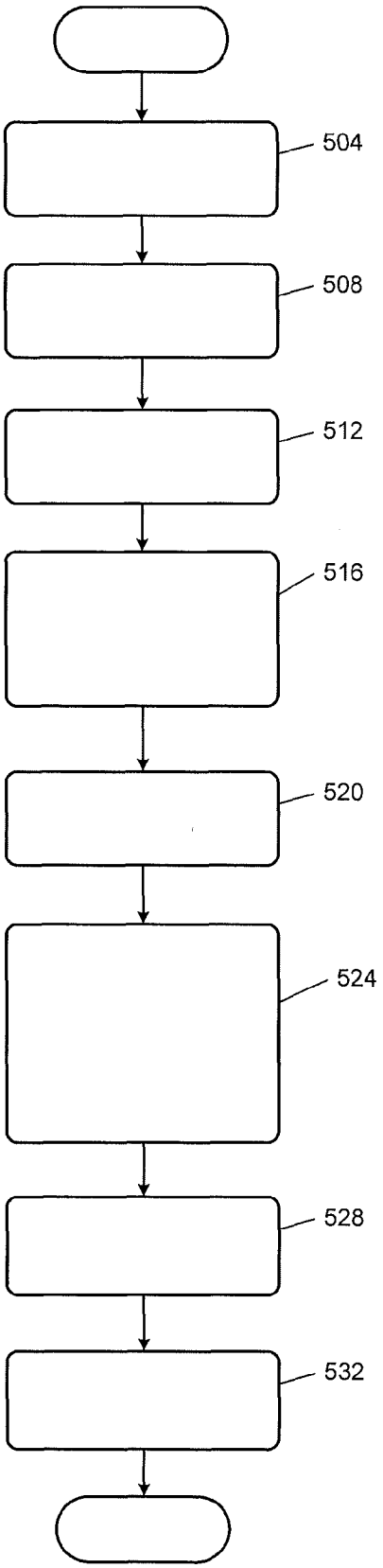
FIG. 5 is a flowchart depicting an example method of controlling cylinder activation and deactivation.

Referring now to FIG. 5, a flowchart depicting an example method of controlling cylinder activation and deactivation is presented. Control may begin with 504 where the torque request module 204 determines the torque request 208. At 508, the firing fraction module 304 determines the target firing fraction 308 based on the torque request 208. The firing fraction module 304 may determine the target firing fraction 308 further based on one or more other parameters, such as the gear ratio 310 engaged within the transmission and the vehicle speed 312.

At 512, the sequence module 316 determines the possible sequences 320 for activating and/or deactivating cylinders to achieve the target firing fraction 308. For example, the possible sequences 320 for each possible target firing fraction may be stored in memory, and the sequence module 316 may retrieve the possible sequences 320 for the target firing fraction 308 from memory.

The fueling module 324 determines the fuel consumption values 328 for the possible sequences 320, respectively, at 516. The fueling module 324 determines the fuel consumption value for a possible sequence based on the possible sequence, the engine speed 332, and the engine load 336.

At 520, the identification module 340 determines the lowest one of the fuel consumption values 328 determined for the possible sequences 320, respectively. At 524, the identification module 340 filters out ones of the possible sequences 320 having fuel consumption values that are more than the predetermined amount or percentage from the lowest one of the fuel consumption values 328. The identification module 340 also outputs one of the possible sequences 320 having fuel consumption values that are less than the predetermined amount or percentage from the lowest one of the fuel consumption values as the identified possible sequences 344 at 524.

At 528, the selection module 348 selects one of the identified possible sequences 344 and outputs the selected one of the identified possible sequences 344 as the selected target sequence 380. For example, the selection module 348 may select the one of the identified possible sequences 344 that minimizes seat track acceleration, crankshaft torsion, and/or accessory drive disturbances. The accessory disturbance module 364 determines the accessory drive system disturbance values 352 for the identified possible sequences 344, respectively. The torsion module 368 determines the torsion values 356 for the identified possible sequences 344, respectively. The seat acceleration module 372 determines the seat track acceleration values 360 for the identified possible sequences 344, respectively.

The command module 376 generates the firing command 248 for the next cylinder in the predetermined firing order of the cylinders at 532 according to the first entry in the selected target sequence 380. The cylinder actuator module 120 activates or deactivates the next cylinder in the predetermined firing order based on the firing command 248. While the example of FIG. 5 is shown as ending after 532, FIG. 5 illustrates one control loop and control loops are performed at a predetermined rate.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium include nonvolatile memory circuits (such as a flash memory circuit or a mask read-only memory circuit), volatile memory circuits (such as a static random access memory circuit and a dynamic random access memory circuit), and secondary storage, such as magnetic storage (such as magnetic tape or hard disk drive) and optical storage.

The apparatuses and methods described in this application may be partially or fully implemented by a special purpose computer created by configuring a general purpose computer to execute one or more particular functions embodied in computer programs. The computer programs include processor-executable instructions that are stored on at least one non-transitory, tangible computer-readable medium. The computer programs may also include or rely on stored data. The computer programs may include a basic input/output system (BIOS) that interacts with hardware of the special purpose computer, device drivers that interact with particular devices of the special purpose computer, one or more operating systems, user applications, background services and applications, etc.

The computer programs may include: (i) assembly code; (ii) object code generated from source code by a compiler; (iii) source code for execution by an interpreter; (iv) source code for compilation and execution by a just-in-time compiler, (v) descriptive text for parsing, such as HTML (hypertext markup language) or XML (extensible markup language), etc. As examples only, source code may be written in C, C++, C#, Objective-C, Haskell, Go, SQL, Lisp, Java®, ASP, Perl, Javascript®, HTML5, Ada, ASP (active server pages), Perl, Scala, Erlang, Ruby, Flash®, Visual Basic®, Lua, or Python®.

None of the elements recited in the claims is intended to be a means-plus-function element within the meaning of 35 U.S.C. §112(f) unless an element is expressly recited using the phrase "means for", or in the case of a method claim using the phrases "operation for" or "step for".

What is claimed is:

1. A cylinder control system for a vehicle, comprising:

a torque request module that generates a torque request for an engine based on at least one driver input;

a firing fraction module that, based on the torque request, determines a target number of activated cylinders of the engine;

a sequence module that determines possible sequences for activating and deactivating cylinders of the engine to achieve the target number of activated cylinders;

a fueling module that determines predicted fuel consumption values for the possible sequences, respectively;

an identification module that identifies first ones of the possible sequences having predicted fuel consumption values that are less than a predetermined amount from a lowest one of the predicted fuel consumption values;

a selection module that selects one of the first ones of the possible sequences and that sets a selected sequence for activating and deactivating cylinders of the engine to the selected one of the first ones of the possible sequences; and a command module that, based on the selected sequence, commands one of activation and deactivation of a next cylinder in a predetermined firing order of the cylinders and that one of activates and deactivates the next cylinder based on the command.

2. The cylinder control system of claim 1 wherein the fueling module determines the predicted fuel consumption values for the possible sequences based on the sequences for activating and deactivating cylinders of the possible sequences, respectively.

3. The cylinder control system of claim 2 wherein the fueling module determines the predicted fuel consumption values further based on one or more cylinder activation/deactivation states of one or more previous cylinders, respectively, in the predetermined firing order of the cylinders.

4. The cylinder control system of claim 2 wherein the fueling module determines the predicted fuel consumption values further based on an engine speed.

5. The cylinder control system of claim 2 wherein the fueling module determines the predicted fuel consumption values further based on an engine load.

6. The cylinder control system of claim 1 wherein the fueling module determines the predicted fuel consumption values for the possible sequences based on the sequences for activating and deactivating cylinders of the possible sequences, respectively, an engine speed, and an engine load.

7. The cylinder control system of claim 1 further comprising an accessory disturbance module that determines accessory disturbance values for the first ones of the possible sequences, respectively, wherein the selection module selects one of the first ones of the possible sequences having a lowest accessory disturbance value.

8. The cylinder control system of claim 1 further comprising a torsion module that determines crankshaft torsional vibration values for the first ones of the possible sequences, respectively, wherein the selection module selects one of the first ones of the possible sequences having a lowest crankshaft torsional vibration value.

9. The cylinder control system of claim 1 further comprising a seat acceleration module that determines an acceleration at a seat track within a passenger cabin of the vehicle for the first ones of the possible sequences, respectively, wherein the selection module selects one of the first ones of the possible sequences having a lowest acceleration.

10. The cylinder control system of claim 1 wherein the identification module further identifies second ones of the possible sequences having predicted fuel consumption values that are greater than the predetermined amount from the lowest one of the predicted fuel consumption values and prevents the selection module from selecting the second ones of the possible sequences.

11. A cylinder control method for a vehicle, comprising:

generating a torque request for an engine based on at least one driver input;

based on the torque request, determining a target number of activated cylinders of the engine;

determining possible sequences for activating and deactivating cylinders of the engine to achieve the target number of activated cylinders;

determining predicted fuel consumption values for the possible sequences, respectively;

identifying first ones of the possible sequences having predicted fuel consumption values that are less than a predetermined amount from a lowest one of the predicted fuel consumption values;

selecting one of the first ones of the possible sequences;

setting a selected sequence for activating and deactivating cylinders of the engine to the selected one of the first ones of the possible sequences;

based on the selected sequence, commanding one of activation and deactivation of a next cylinder in a predetermined firing order of the cylinders; and one of activating and deactivating the next cylinder based on the command.

12. The cylinder control method of claim 11 further comprising determining the predicted fuel consumption values for the possible sequences based on the sequences for activating and deactivating cylinders of the possible sequences, respectively.

13. The cylinder control method of claim 12 further comprising determining the predicted fuel consumption values further based on one or more cylinder activation/deactivation states of one or more previous cylinders, respectively, in the predetermined firing order of the cylinders.

14. The cylinder control method of claim 12 further comprising determining the predicted fuel consumption values further based on an engine speed.

15. The cylinder control method of claim 12 further comprising determining the predicted fuel consumption values further based on an engine load.

16. The cylinder control method of claim 11 further comprising determining the predicted fuel consumption values for the possible sequences based on the sequences for activating and deactivating cylinders of the possible sequences, respectively, an engine speed, and an engine load.

17. The cylinder control method of claim 11 further comprising:

determining accessory disturbance values for the first ones of the possible sequences, respectively; and selecting one of the first ones of the possible sequences having a lowest accessory disturbance value.

18. The cylinder control method of claim 11 further comprising:

determining crankshaft torsional vibration values for the first ones of the possible sequences, respectively; and selecting one of the first ones of the possible sequences having a lowest crankshaft torsional vibration value.

19. The cylinder control method of claim 11 further comprising:

determining an acceleration at a seat track within a passenger cabin of the vehicle for the first ones of the possible sequences, respectively; and selecting one of the first ones of the possible sequences having a lowest acceleration.

20. The cylinder control method of claim 11 further comprising:

identifying second ones of the possible sequences having predicted fuel consumption values that are greater than the predetermined amount from the lowest one of the predicted fuel consumption values; and preventing the selection of the second ones of the possible sequences.

* * * * *